United States Patent [19]

Eggert et al.

[11] 4,418,787

[45] Dec. 6, 1983

[54] HEARING AID WITH AUDIO PATH DUCT EXTENSION ELEMENT, AND EXTENSION ELEMENT ATTACHMENT

[75] Inventors: Albert Eggert; Erwin Gahleitner; Joachim Kwiatkowski, all of Berlin, Fed. Rep. of Germany

[73] Assignee: Robert Bosch GmbH, Stuttgart, Fed. Rep. of Germany

[21] Appl. No.: 276,520

[22] Filed: Jun. 23, 1981

[30] Foreign Application Priority Data

Jun. 26, 1980 [DE] Fed. Rep. of Germany ..... 3023871

[51] Int. Cl.[3] ..... H04R 25/00

[52] U.S. Cl. ..... 181/130

[58] Field of Search ..... 138/42, 178; 179/107 R, 179/107 E, 107 H, 182; 181/129, 130, 135, 196

[56] References Cited

U.S. PATENT DOCUMENTS

| | | | |
|---|---|---|---|
| 3,080,011 | 3/1963 | Henderson | 181/135 |
| 3,312,789 | 4/1967 | Lewis et al. | 179/107 E |
| 3,632,140 | 1/1972 | Paine et al. | 138/178 X |
| 3,947,939 | 4/1976 | Steiner | 138/42 X |
| 4,296,829 | 10/1981 | Pedersen | 181/129 |

FOREIGN PATENT DOCUMENTS

| | | | |
|---|---|---|---|
| 1274658 | 8/1968 | Fed. Rep. of Germany . | |
| 289719 | 5/1928 | United Kingdom | 181/130 |

*Primary Examiner*—Thomas H. Tarcza

*Attorney, Agent, or Firm*—Frishauf, Holtz, Goodman & Woodward

[57] ABSTRACT

To match the frequency characteristics of the audio or acoustic path of a hearing aid to the remainder of the hearing aid system, an acoustic path extension element (10, 25, 40, 48, 52) is interposed in the acoustic path, the extension element being structural components separable and independent of the housing of the hearing aid, although it may be retained therein (FIG. 3), to permit matching of elements having different path lengths to the hearing aid. In a preferred form, the entrance and exit openings of the separable element are coaxial to permit replacement of existing audio duct connecting tubes, at least in part, by the element and thus permit adaptation and retrofitting of hearing aids with the matching element.

15 Claims, 6 Drawing Figures

Figure 1:
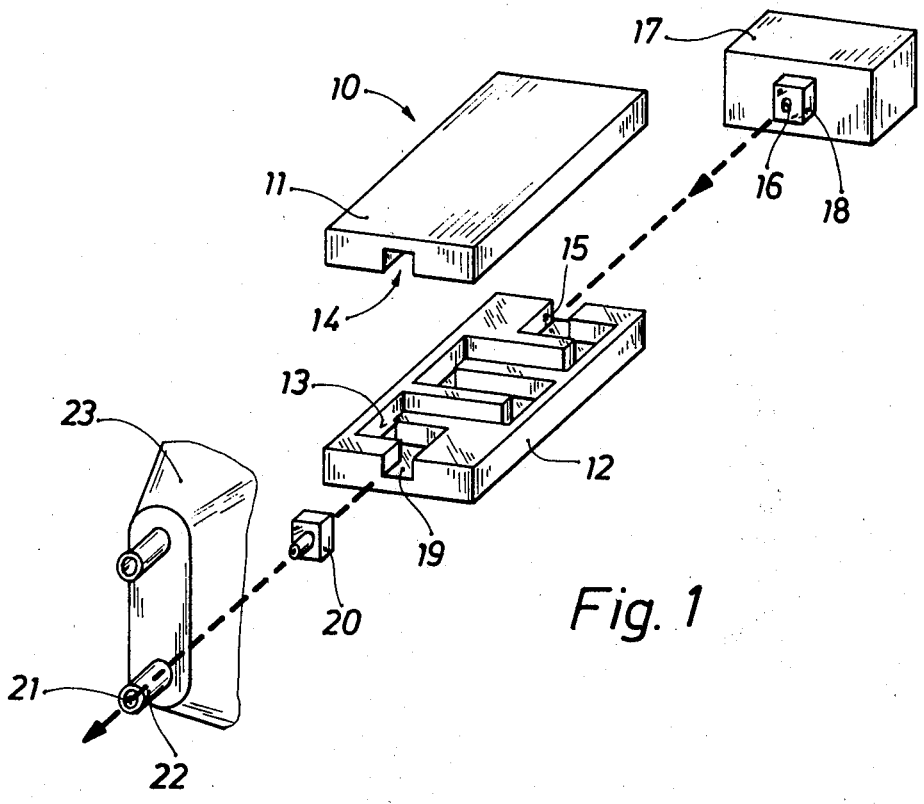

Fig. 3a
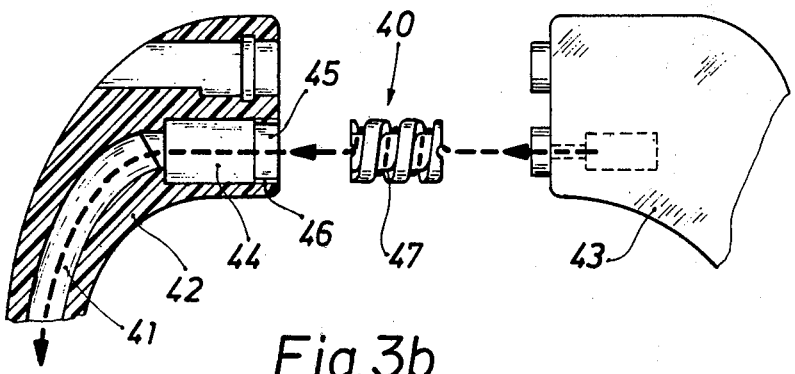
Fig. 3b
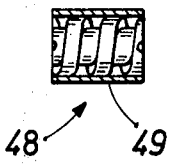
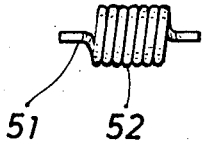
Fig. 3c

HEARING AID WITH AUDIO PATH DUCT EXTENSION ELEMENT, AND EXTENSION ELEMENT ATTACHMENT

REFERENCE TO RELATED PUBLICATION

German Patent No. 1 274 658, HEYNE, assigned to the assignee of the present application.

The present invention relates to a hearing aid, and more particularly to a hearing aid having an extended audio path duct, and further to an attachment or retrofit element to extend the hearing aid audio path.

BACKGROUND

Various miniature-type hearing aids are known, preferably of the type which can be carried on the ear of a wearer—see, for example, the referenced German Patent DE-PS No. 1 274 658, HEYNE. This publication describes a hearing aid which includes an extended audio duct so that the path of sound waves incident on the hearing aid from the exit opening therefrom to a sound processing station is prolonged. Extending the audio duct influences the frequency response. In very small or miniature hearing aids, the transmission characteristics of sound through the hearing aid duct should be matched to the frequency response and, unless the hearing aid duct has some predetermined minimum length, the low frequency response of the device as a whole may be unsatisfactory. It has therefore been proposed to use the housing of the hearing aid to extend the audio path by forming an audio duct therein in such a manner that the length of the audio path between the sound entrance opening and the exit opening from the audio duct is as long as possible. This hearing aid, while having improved frequency response, is so constructed that the hearing aid receiver and the sound extending path or duct form a single unit. It is not possible, therefore, to improve the frequency response of already existing hearing aids which do not have the extended sound path built into the unit itself, nor is it possible to match the frequency response of the overall sound transmission system formed by the hearing aid and the sound path to optimum values satisfactory to a user. Extending, for example, the sound duct, so that the audio path length is extended, is possible only by completely reworking the housing, which is difficult, and, since the housing is usually a plastic molding, practically impossible.

THE INVENTION

It is an object to permit ready matching of the sound path for sound traveling within a hearing aid system to desired characteristics.

Briefly, a separable element is releasably inserted in the audio path at a desired position thereof, for example as a coupling element between a sound receiving structure and a sound processing structure; the separable, insertable element includes a tortuous path for sound transmitted between the structures. The tortuous path can be formed by an internal meander track within the coupling element or, for example, by providing the coupling element in form of a worm, similar to a worm gear, with deep grooves, so that the sound has to travel in a spiral path about a center, the pitch of the spiral path determining the length of the sound path within the element.

The element, together with a housing portion thereof, can be formed as a separable, insertable unit and made with sound path lengths which vary from unit to unit, so that the most desirable element can be selected by a user to match the frequency characteristics for most desirable reproduction. The element can, additionally, be made so that it can fit between the sound receiving and sound processing units of existing hearing aid systems, so that hearing aid systems which have no extended sound path duct at all can be retrofitted to improve their frequency response.

The hearing aid, and the attachment or retrofit element thereof, has the advantage that existing hearing aids can be retrofitted later, and that, to determine the most suitable length of the sound duct, the elements can be interchanged, for example for testing, or for later re-adaptation. The sound path extension element can be placed at any suitable position within the path of sound from the sound exit opening of the sound receiver, and the sound entrance opening of the sound processing stage or unit.

In accordance with a preferred feature of the invention, the arrangement is so made that the sound entrance opening and the sound exit opening of the sound path extending element are coaxial. This permits introducing or inserting the element within an existing range or region of a hearing aid system, for example between the sound exit opening of the pick-up unit, and the sound entrance opening of the hearing aid processing stage in a hearing aid system of the type which is generally quarter-moon shaped, or sickle-shaped, to fit behind the ear of a wearer; it may, also, be used to replace a sound tube, which usually is flexible, wholly or in part.

Figure 2B:
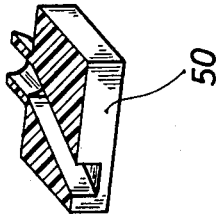
Figure 2A:
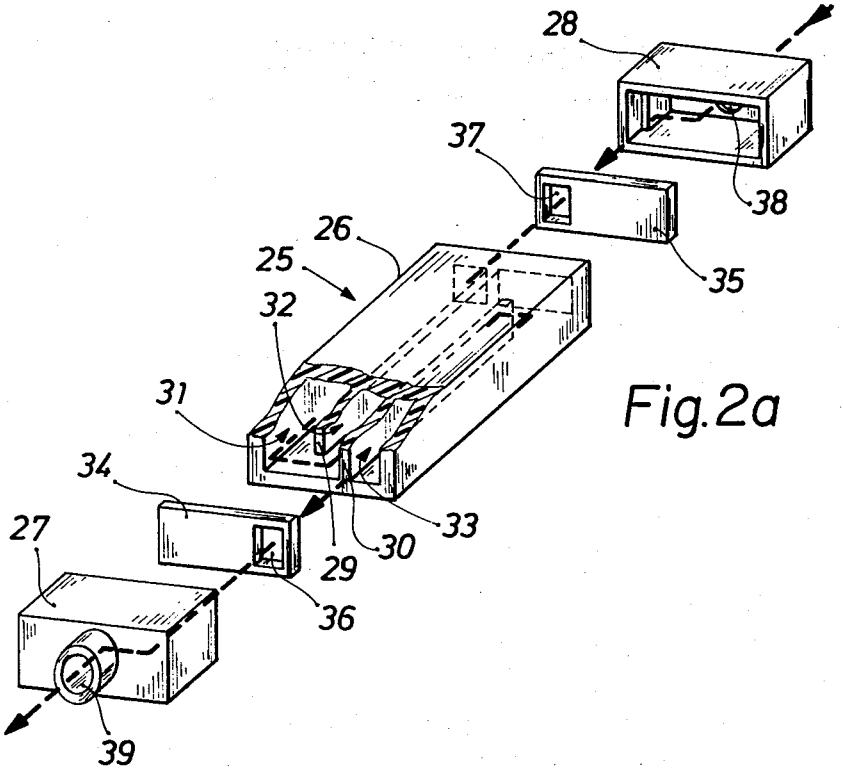

DRAWINGS:

FIG. 1 is an exploded perspective view of one form of a sound path extending element and showing coupling of the element to components of a hearing aid system;

FIG. 2*a* is a perspective exploded view, partly in section and broken away, of a block-like sound path extending element;

FIG. 2*b* is a half-section through another embodiment of a component of the system of FIG. 2*a;*

FIG. 3*a* is a part-sectional, part-exploded view of a quarter-moon or sickle-shaped system with a sound path extending element incorporated in the unit adapted to be worn behind the ear of a user;

FIG. 3*b* illustrates another embodiment of the element; and

FIG. 3*c* shows yet a further embodiment of the element, suitable for use with the system of FIG. 3*a*.

Basic system, and embodiment of FIG. 1: A sound receiving unit 17 picks up sound for transmission to a sound processing unit, schematically shown at 23. Interposed in the path of sound from the receiving or pick-up unit to the processing stage or unit 23 is a sound path extending unit 10, and forming the subject matter of the present invention. The sound path extending unit 10 is an essentially block-like element formed of two half-shells 11, 12. The half-shells have, at their facing sides, meander-like grooves 13. When the half-shells 11, 12 are assembled together, a sound duct 14 of substantially greater length than the distance between the entry opening 15 and the exit opening 19 of element 10 will be formed. The sound entry opening 15 is fitted to an extension 18 of the pick-up unit 17 such that the sound exit opening 16 from the pick-up unit 17 is sound-tight fitted into the opening 15; similarly, the sound exit opening 19 of the element 10 is coupled over an elastic coupling element 20 with the sound exit opening 21 of a hollow cylindrical stub 22 of the hearing aid sound processing unit 23, for example of sickle shape, and adapted to be worn behind the ear of a user.

The half-shells 11 and 12 of the acoustic path-extending element 10 are connected together, for example by adhesion, so as to be irremovably joined. This permits testing of the element 10 before being assembled together with a hearing aid system for functional operability and characteristics. Preferably, elements 10 with various acoustic path lengths are made, to fit the respective elements 18, 20, so that the acoustic path length of a selected element can be matched to a specific hearing aid. That one of the selected elements 10 is then assembled with the hearing aid which most closely approaches the desired frequency transfer characteristics, so that the overall system will have the desired frequency response.

The sound exit opening 16 of the sound input unit 17, the sound input opening 15, the sound exit opening 19 of the element 10, the coupling element 20, and the sound exit opening 21 of the stub 22 preferably are so located that they are on a single axis, as schematically shown in FIG. 1. This coaxial arrangement then permits introducing the acoustic path extension element 10 into an already existing hearing aid or hearing aid system in which, as is customary, the sound exit opening 21 of the stub 22 and the sound exit opening 16 of the input unit or pick-up 17 are connected by an elastic sound duct, typically a flexible tube or hose. The element 10 can then either replace the tube or hose, or, if smaller than the length of the connecting tube, can be fitted into a shorter piece, for example by connecting the tube to element 20 and to the exit opening 21 of stub 22.

Embodiment of FIG. 2

The acoustic or audio path extension element 25 presents a tortuous path to sound waves, as indicated in the part-phantom view of FIG. 2*a*. The element 25 has, essentially, a central part 26 and two terminal end pieces 27, 28. The central part 26 is subdivided by webs 29, 30 into open ducts 31, 32, 33. The webs terminate short of the ends of the central part 26, as shown, to establish or define a meander-shaped connection of the ducts. The meander arrangement of the ducts is additionally determined by closure plates 34, 35 which each, have an opening 36, 37. The opening 36 of the closure plate 34 permits acoustic communication only between the acoustic duct 33 and the connecting end portion 37. The opening 37 in the closure element 35 permits acoustic communication only with the interior of the end element 28. The web 29 is slightly shorter at the end facing the connecting or end element 27 than the center part 26; the web 30 is slightly shorter at the end facing the end connecting part 28. The closure plates 34, 35 are so fitted into the cap-formed end parts 27, 28 that a duct will remain between the bottom of the end part and the plate which is in acoustic duct communication with external acoustic or sound transmission openings 38, 39, respectively. The parts 26, 27, 28, and 34, 35 preferably are made of plastic and are adhered together by a plastic adhesive or cement. The sound entrance opening 38 and the sound exit opening 39 of the completely assembled unit are coaxial, the sound path being deflected within the end elements.

FIG. 2*b* illustrates an alternative; rather than using two-component end pieces, that is, end pieces which include the cap 28 and plate 35, and cap 27 and the plate 34, respectively, are replaced by a single one-piece end part 50 which has an inclined sound channel or duct, as seen in the half section of FIG. 2*b*. A similar part and being a mirror image thereof can be fitted thereover to be then adhered to the center part 25 by a plastic adhesive or cement.

EMBODIMENT OF FIG. 3

The acoustic path extension element 40 is in form of a worm, similar to a worm of a worm gear, or of an Acme thread. The acoustic path extension element 40 is releasably secured to the sound entrance opening of an angle element 42, being fitted into the acoustic path or duct therein. The sickle-shaped, bent or quarter-moon shaped housing 43, adapted to be worn behind the ear of the user, is formed with a cylindrical receiving opening 44, communicating with the sound duct 41 therein. The receiving opening 44 is constricted at its end portion, as seen at 45, and formed in this constricted region with a thread 46 which matches the thread of the sound path extension element 40. This permits threading element 40 into the enlarged opening 44 through the end part 45, thus retaining element 40 securely within the part 42, safe against loss. Yet, the element 40 can be removed, for example for cleaning or replacement within the part 42. The sound duct is formed in this embodiment by the spiral path defined by the thread spiral 47 of the acoustic path extension element 40, in combination with the adjacent inner wall surfaces of the enlarged opening 44. Depending on the pitch and the length of the thread of the element 40, bodies of this type can be made with different path lengths. FIG. 3 illustrates the acoustic path in broken-line representation.

FIG. 3*b* illustrates a modified form of acoustic path length extension element 48 in which a body similar to body 40 is surrounded by a sleeve 49 so that an acoustic path length extension element is formed which can be tested before assembly into the hearing aid. If an element 48 is used, the entrance opening of the enlarged duct 44 should not be constricted as in 45. Rather than using a preformed sleeve 49, a freely fitting sleeve made of a heat shrinkable plastic material can be used which tightly surrounds the outer portions of the thread circumference of the thread 47, leaving free the space between the roots of the thread to form the extended acoustic path.

FIG. 3*c* illustrates an element 52 formed as a spiral winding of a hollow tube 51, communicating with and coupled to the sound duct 41, and the exit opening of sound from the element 43 (FIG. 3*a*) for example.

Various changes and modifications may be made, and features described in connection with any one of the embodiments may be used with any of the others, within the scope of the inventive concept.

We claim:

1. Hearing aid comprising a sound receiving structure (43);

a sound processing structure (42);

connecting means interconnecting said structure in sound transmitting relation and means for defining a sound duct or audio path between the sound receiving structure and the sound processing structure; and an acoustic path extension element (40) forming a separable element which is removably insertable at a desired position into said audio path and defines, in combination with said connecting means, an audio path of effective length greater than the distance separating said receiving and processing structure;

wherein said acoustic path extension element is in form of a spiral and comprises a sinuous or tortuous channel.

2. Hearing aid according to claim 1, wherein (FIG. 3) a half-moon or sickle-shaped housing (42, 43) is provided formed of separate housing parts (42, 43), and forming, respectively, the sound receiving and sound processing structures, each one including a sound duct or channel (41) formed therein and forming the sound duct or audio path;

and wherein at least one of said parts includes an enlarged opening communicating with said sound duct and retaining said separable element (40).

3. Hearing aid according to claim 1, wherein said separable acoustic path extension element comprises an essentially cylindrical body with a spiral thread (47) formed thereon in shape of a worm to provide said sinuous or tortuous audio path.

4. Hearing aid according to claim 3, wherein a housing is provided including a housing part formed with an enlarged opening communicating with the sound duct and retaining said separable acoustic path extension element therein, said housing comprising at least one of said sound receiving structure and said sound processing structure;

and wherein said opening in the housing is shaped to receive said worm, the extended audio path being defined by the inner wall of said opening and the pitch of said worm.

5. Hearing aid according to claim 4, wherein the opening (44) in said part (42) receiving the worm (40) has a constricted entrance portion (45) formed with a thread region matching the thread of said worm (47) to permit screwing said worm into the said one part for retention therein secure against loss.

6. Hearing aid according to claim 3, further including (FIG. 3*b*) a sleeve (49) surrounding the outer dimension of the threads of the worm.

7. Hearing aid according to claim 6, wherein the sleeve comrises a heat shrinkable plastic material.

8. Hearing aid according to claim 1, wherein said removable acoustic path extension element (52) comprises a tube (51) wound in a spiral.

9. In combination with, a hearing aid having, a sound receiving structure, a sound processing structure, separable from the sound receiving structure and means for defining a sound duct or audio path between the sound receiving structure and the sound processing structure, and a removable acoustic path extension element comprising an acoustic wave guide element defining a tortuous or labyrinthine or sinuous audio path for sound transmitted therethrough, said element being an elongated body of plastic material having therein a groove or duct longer than the length of said elongated body;

said acoustic wave guide element being formed with sound entrance and exit openings which are positioned in axial alignment, at respective end portions of the elongated body;

and wherein said sound receiving structure and said sound processing structure, respectively, is formed with sound receiving openings in matching position with said sound entrance and exit openings of the acoustic wave guide element.

10. Element according to claim 9, wherein said element comprises a two-component body, each formed with matching meander-formed grooves therein, said meander-formed grooves providing said labyrinthine tortuous path.

11. Element according to claim 9 wherein said body comprises a block-like structure having interior webs positioned to define said tortuous or labyrinthine path and entrance and exit terminal parts forming a sound path and connecting the terminal portions of said labyrinthine path to the axially aligned sound entrance and exit openings of said element.

12. Element according to claim 9, wherein the body of said element is essentially cylindrical and formed with an external worm of screw thread terminating in axially centrally positioned recesses forming the entrance and exit openings insertable into a surrounding body formed with a cylindrical opening, the inner walls of said body, together with the depressions defined by said screw thread, forming said labyrinthine or tortuous path.

13. Element according to claim 12, wherein said surrounding body comprises a sleeve of plastic material.

14. Element according to claim 9, wherein said body of plastic material comprises a spirally wound plastic tube having end portions positioned in axial alignment parallel to the axis of said tube.

15. Hearing aid comprising a sound receiving structure;

a sound processing structure;

an acoustic path extension element forming a separate unit having formed, internally, a continuous interconnected labyrinthine path, and having entrance and exit openings at opposed end portions;

end connecting elements including window elements having openings matching the end portions of said labyrinthine path and providing acoustic path communication interiorly of the end portions;

and sound exit and entrance openings formed in said end portions, said sound exit and entrance openings being positioned in axial alignment.

* * * * *